US009109321B2

(12) United States Patent
Hettinger et al.

(10) Patent No.: US 9,109,321 B2
(45) Date of Patent: Aug. 18, 2015

(54) DEVICE AND METHOD FOR RINSING OBJECTS IN AN APPLIANCE

(75) Inventors: Stephen Edward Hettinger, Louisville, KY (US); Daniel Stephen Frazer, West Chester, OH (US); Peter Hans Bensel, Grand Ledge, MI (US); Manikandan Balasubramaniam, Louisville, KY (US)

(73) Assignee: General Electric Company, Schenectady, NY (US)

( * ) Notice: Subject to any disclaimer, the term of this patent is extended or adjusted under 35 U.S.C. 154(b) by 401 days.

(21) Appl. No.: 13/070,515

(22) Filed: Mar. 24, 2011

(65) Prior Publication Data

US 2012/0240638 A1 Sep. 27, 2012

(51) Int. Cl.
*D06F 29/00* (2006.01)
*D06F 39/08* (2006.01)

(52) U.S. Cl.
CPC ..... *D06F 39/088* (2013.01)

(58) Field of Classification Search
CPC ..... D06F 39/088
USPC ..... 68/23.5, 200; 134/198
See application file for complete search history.

(56) References Cited

U.S. PATENT DOCUMENTS

| | | | | |
|---|---|---|---|---|
| 3,663,975 | A * | 5/1972 | Fish et al. | 8/158 |
| 3,867,821 | A | 2/1975 | Hurwitz | |
| 4,022,382 | A * | 5/1977 | Engdahl, Jr. | 239/754 |
| 7,424,810 | B2 | 9/2008 | Zaccone et al. | |
| 7,426,932 | B2 | 9/2008 | Zaccone | |
| 2007/0067920 | A1 * | 3/2007 | Zaccone | 8/158 |

FOREIGN PATENT DOCUMENTS

JP 2002282587 A * 10/2002

OTHER PUBLICATIONS

Machine Translation of Ise et al, JP 2002282587 A, Oct. 2002.*

* cited by examiner

*Primary Examiner* — David Cormier
(74) *Attorney, Agent, or Firm* — Dority & Manning, P.A.

(57) ABSTRACT

An appliance for washing objects that employs a spray device for delivering a washing fluid, e.g., water, to a wash tub in the appliance. The spray device is configured to reduce consumption of the washing fluid such as during a rinse portion of a washing cycle. In one example, the spray device comprises a plurality of apertures that are arranged in one or more arrays. The apertures are configured to disperse the washing fluid as a plurality of spray streams that form a pair of wetted areas on either side the wash tub. The wetted areas provide wetting of the objects along the sides and extending from a front portion to a back portion of the wash tub.

11 Claims, 11 Drawing Sheets

DEVICE AND METHOD FOR RINSING OBJECTS IN AN APPLIANCE

BACKGROUND OF THE INVENTION

The subject matter disclosed herein relates generally to appliances, and more particularly, to a spray device and implementation thereof for reducing the consumption of a washing fluid, e.g., water, in the appliance such as during one or more rinse cycles.

Some appliances such as household washing machines typically include a cabinet that houses an outer tub for containing wash and rinse water, a perforated wash basket within the tub, and an agitator within the basket. A drive and motor assembly is mounted underneath the stationary outer tub to rotate the basket and the agitator relative to one another, and a pump assembly is configured to pump water from the tub to a drain to execute a wash cycle.

These wash cycles often include a rinse portion with a deep-fill process wherein objects (e.g., articles of clothes) in the basket are completely submerged in water and the water is agitated. This process permits a large amount of water to mix with additives (e.g., detergent) that remains in the clothes after they are washed. While the concentration of the additive in the rinse water is relatively small, a large amount of detergent can be removed from the clothes due to the large amount of water involved. For deep-fill cycles this amount is upwards of 12 to 24 gallons, which is discarded in favor of fresh rinse and/or wash water that is dispensed into the wash tub for further cleaning of the objects.

Because it may be desirable to reduce water consumption in washing operations, at least some types of household washing machines employ systems that re-circulate rinse water. In one type of system, rinse water is collected in the bottom of the tub and pumped back through a plurality of spray nozzles located above the basket. The rinse water is re-circulated for a pre-determined period of time before being discharged to a drain. While such systems are effective to reduce water consumption, they require elements such as pumps and conduits, which may result in additional and/or increased material and assembly costs.

There is therefore a need for an appliance such as a washing machine that is configured for reduced water consumption, and more particularly, for configurations of the washing machine that can reduce such consumption during rinse portions of the wash cycle.

SUMMARY OF THE INVENTION

In one embodiment, there is described a spray device for dispersing a washing fluid into a wash zone in an appliance. The spray device comprises a body comprising an inlet and having a central axis. The spray device also comprises an array of apertures disposed on the body, the array of apertures comprising an aperture on either side of the central axis and in flow communication with the inlet. In one example, the array of apertures is configured to eject the washing fluid in a spray pattern with spray streams that form a first wetted region and a second wetted region on either side of the central axis and separated by a non-wetted region located therebetween.

In another embodiment, an appliance comprises a wash zone in which objects to be cleaned are positioned and a spray device in a fixed location relative to the wash zone, the spray device comprising a plurality of apertures arranged in an array. In one example, the array is configured to eject a washing fluid in a spray pattern with spray streams that originate proximate the fixed location and traverse the wash zone to form a first wetted region and a second wetted region on either side of a longitudinal axis of the wash zone.

In yet another embodiment, there is described a method of operating a washing machine having a wash basket in which objects are positioned to be washed. The method comprises a step for performing a first rinse at a first orientation of the wash basket and a step for actuating the wash basket to a second orientation. The method also comprises a step for performing a second rinse at the second orientation. In one example, the first rinse and the second rinse are configured to disperse a washing fluid into a first wetted region and a second wetted region on either side of a longitudinal axis of a wash zone formed in the wash basket.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Figure 1:
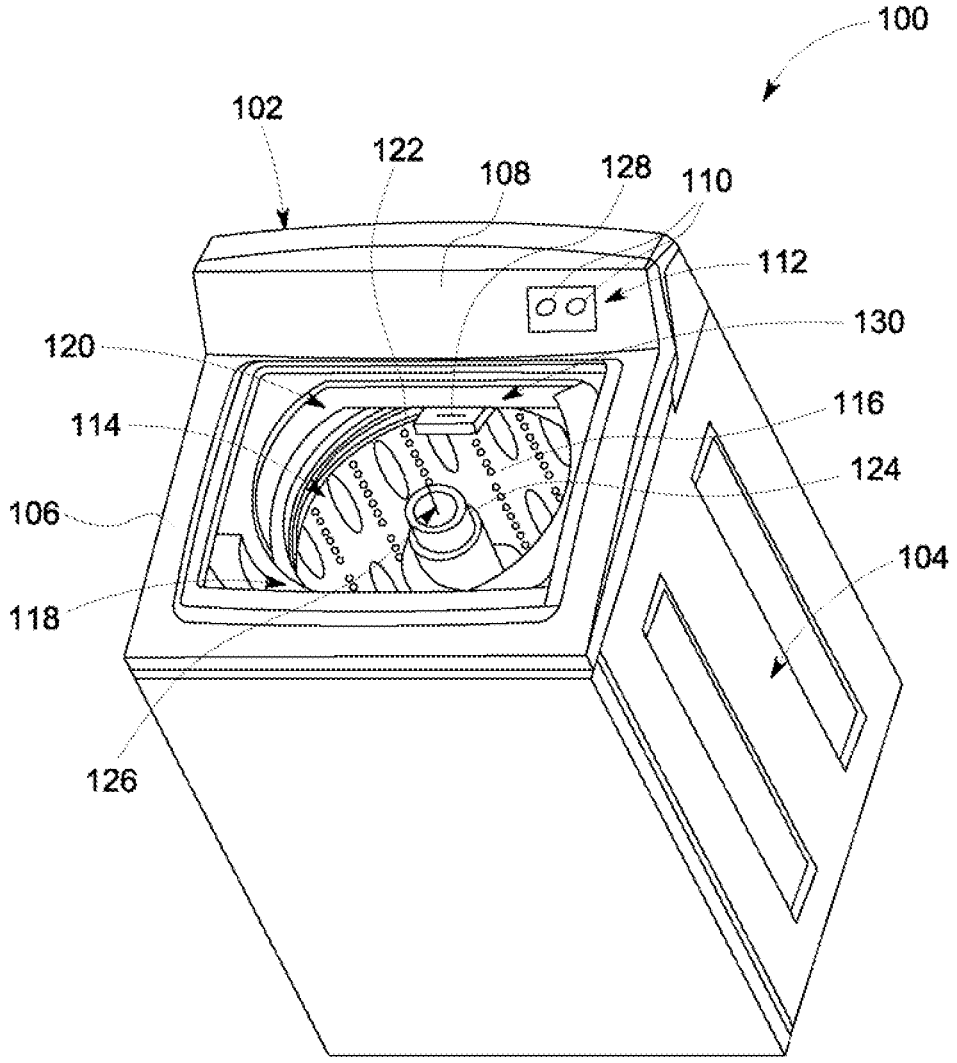
FIG. 1 is a perspective view of an exemplary embodiment of an appliance.

For context and to begin the discussion reference can be had to FIG. 1 in which there is depicted a perspective view of an exemplary embodiment of an appliance 100, and more particularly a vertical-axis washing machine 102 that is made in accordance with the concepts of the present invention. It is contemplated, however, that at least some of the benefits of the concepts recited herein can be realized in other types of appliances, such as horizontal-axis washing machines. These concepts are therefore not intended to be limited to any particular type or configuration of the appliance 100, such as the configuration and features of the vertical-axis washing machine 102.

In the exemplary embodiment, the vertical-axis washing machine 102 includes a cabinet 104 and a cover 106. A backsplash 108 extends from the cover 106 and a variety of control input selectors 110 are coupled to the backsplash 108. The control input selectors 110 form a user interface input 112 for operator selection of machine cycles and features. A wash tub 114 is located within the cabinet 104. Inside of the wash tub 114 is a wash basket 116, which is movably disposed and rotatably mounted in the wash tub 114 in a spaced apart relationship from wash tub 114. The wash basket 116 has a front portion 118, a rear portion 120, and a plurality of perforations 122 to facilitate communication of fluid out of the wash basket 116. An agitator 124 (or impeller or oscillatory basket mechanism) is rotatably positioned in the wash basket 116 on a vertical axis 126, which is substantially aligned and coincident with a center axis (not shown) of the wash basket 116. In one example, the agitator 124 is configured to impart oscillatory motion to articles and liquid in the wash basket 116. The appliance 100 also includes a spray device 128. The spray device 128 is mounted within the cabinet 104 and in the present construction the spray device 128 is secured in a fixed position 130, which is above and proximate the rear portion 120 of the wash basket 116.

Shown at a relatively high level, detailed examples of which are provided below, the spray device 128 is configured to dispense a washing fluid (not shown) (e.g., water) into the wash basket 116 such as for rinsing and washing of objects (e.g., articles of clothing) disposed therein. In one embodiment, the spray device 128 can eject the washing fluid on either side of the agitator 124, and more particularly, the spray device 128 is arranged so that the washing fluid is dispersed to both the front portion 118 and the rear portion 120 of the wash basket 116. This configuration is beneficial because the embodiments of the spray device 128 address the challenge of how to disperse from a single, fixed location (e.g., the fixed position 130) the washing fluid about the wash basket 116. Embodiments of the spray device 128 are pertinent to appliances such as the appliance 100 wherein the relative arrangement of the spray device 128 and the agitator 124 prevents direct line-of-sight or line-of-dispersal access to the front portion 118 of the wash basket 116. As discussed more below, the inventors have developed constructions of the spray device 128 and operation of the appliance 100 that simplifies the construction of the appliance 100 while also providing the added benefits of a feature that is effective for wetting the objects in the wash basket 116.

Figure 2:
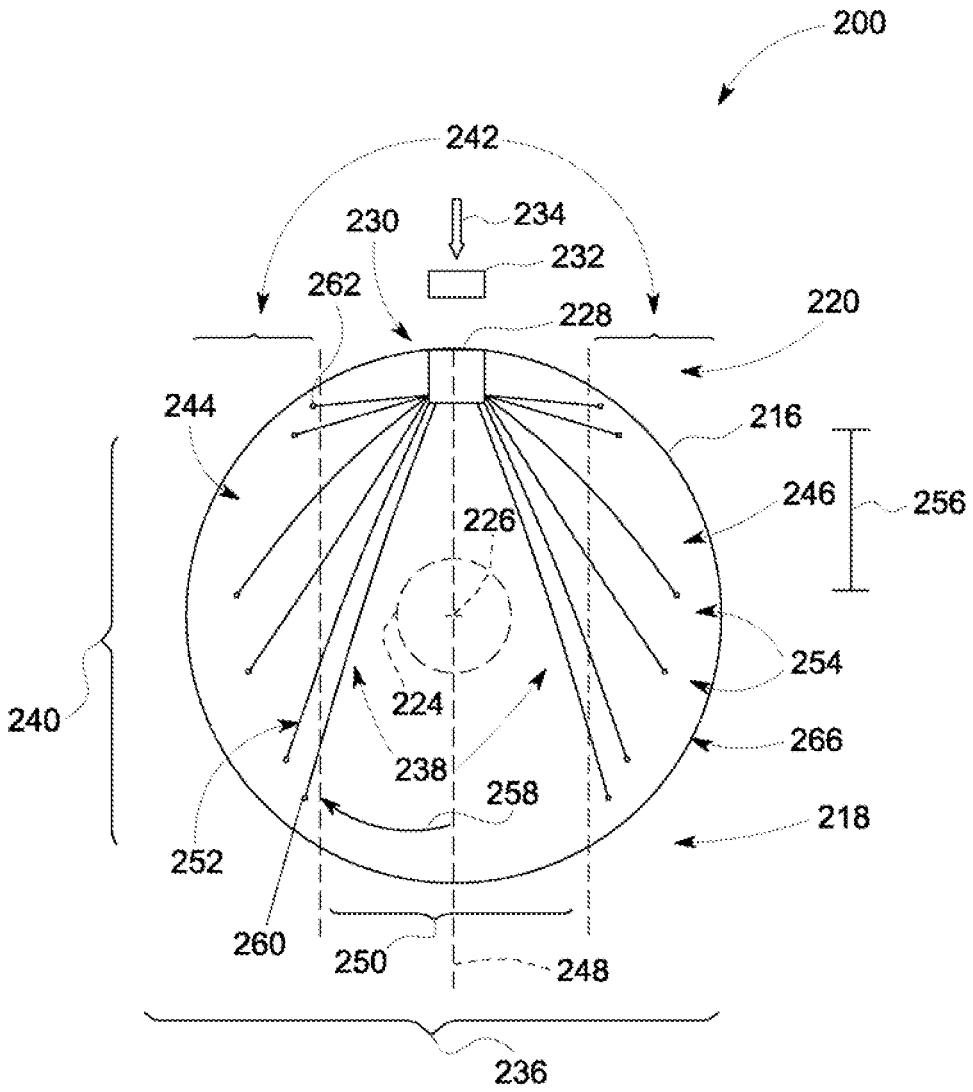
FIG. 2 is a top, schematic view of another exemplary embodiment of an appliance.
Figure 3:
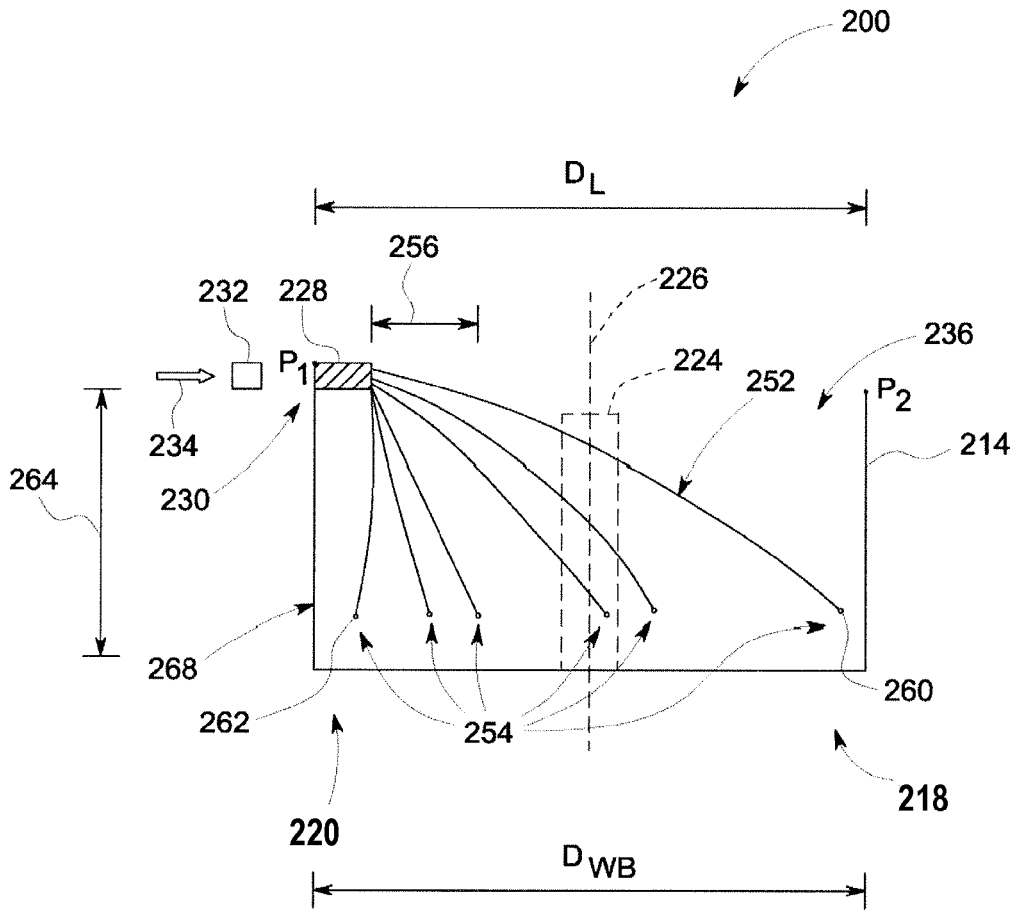
FIG. 3 is a side, schematic view of the appliance of FIG. 2.

These concepts are further illustrated in the exemplary embodiment of an appliance 200 that is depicted in schematic form in FIGS. 2 and 3. While like numerals are used to identify like components as between the FIG. 1 and FIGS. 2 and 3, except that the numerals are increased by 100 (e.g., 100 in FIG. 1 is 200 in FIGS. 2 and 3), some pieces of the appliance 100 have been removed for clarity. In the present example, the appliance 200 includes a wash basket 216 with a front portion 218 and a rear portion 220, an agitator 224 with a vertical axis 226, and a spray device 228 secured in a fixed position 230 relative to the wash basket 216. Other components illustrated and discussed in connection with the appliance 100 (FIG. 1) and other appliance contemplated herein are likewise applicable to the appliance 200, but only discussed where necessary to convey and clarify one or more concepts of the present disclosure.

In one embodiment, the appliance 200 includes a flow device 232, which is coupled to the spray device 228, and through which flows a washing fluid 234 that is dispersed by the spray device 228 into a wash zone 236. The flow device 232 is useful to maintain the pressure of the washing fluid 234 at or about a constant inlet pressure before it is dispersed by the spray device 228 into the wash zone 236. Devices for use as the flow device 232 can include valves, fixed and variable orifices, or other flow control apparatus (and/or methods) to effectuate certain flow characteristics, including the constant inlet pressure, for the washing fluid 234.

The spray device 228 is configured to distribute the washing fluid 234 in a spray pattern 238 about either side of the agitator 224. The spray pattern 238 includes a plurality of spray streams 240 that traverse variously the wash zone 236 and that form in the wash zone 236 one or more wetted regions 242. The wetted regions 242 comprise a first wetted region 244 and a second wetted region 246 (collectively, "the wetted regions") that are located on opposite sides of a longitudinal axis 248 of the wash zone 236. The longitudinal axis 248 extends through the vertical axis 226 so as to bisect the wash zone 236. A non-wetted region 250 separates the wetted regions, whereby the non-wetted region 250 defines a portion of the wash zone 236 that is not directly wetted by the washing fluid 234 in the spray pattern 238. As depicted in the present example, the non-wetted region 250 includes a portion of the wash zone 236 that is directly in front of and behind the agitator 224.

With continued reference to FIG. 2, each of the spray streams 240 has a spray trajectory 252 that defines the trajectory or path of the spray streams 240 from the spray device 228 to, in one example, a location 254 in one or more of the wetted regions 242. The location 254 is defined by a distance 256 and an angular offset 258. In one embodiment, the distance 256 measures the distance the spray streams 240 travel from the spray device 228. The angular offset 258 indicates the angular offset from the longitudinal axis 248. In the present example, the spray device 228 is configured so that the spray streams 240 terminate at least at a first spray location 260 proximate the front portion 218 and a second spray location 262 proximate the rear portion 220.

As best depicted in FIG. 3, the location 254 is further defined by a height 264 or the change in the vertical position of the washing fluid 234 as the washing fluid 234 traverses the wash basket 216 and/or the wash zone 236 from the spray device 228. The height 264 is generally fixed such as by way of the orientation and arrangement of the spray device 228 in the fixed position 230. The wash zone 236 is depicted with outer points, e.g., outer points $P_1$ and $P_2$, and a longitudinal dimension $D_L$, which measures the distance between the outer points $P_1$ and $P_2$. In one embodiment, the location of the outer points $P_1$ and $P_2$, and the value of the longitudinal dimension $D_L$, are defined in accordance with the dimensions of the wash basket 216. Consider in the present example that the wash basket 216 comprises a circular body 266 (FIG. 2) of diameter $D_{WB}$ and with an outer peripheral wall 268 that bounds and defines the wash zone 236. In one example, at least one of the first wetted region 244 and the second wetted region 246 extends from a first location proximate the spray device 228 to a second location spaced apart from the first location a distance of at least 50% of the diameter $D_{WB}$ of the circular body 266 (FIG. 2). In another example, the distance is at least about 85% of the diameter $D_{WB}$.

In one embodiment, the wetted regions are substantially symmetrical about the longitudinal axis 248. That is, the spray device 228 is configured so that the spray pattern 238, and more particularly the spray streams 240 (FIG. 1) are dispersed from a single location (e.g., the fixed position 230) to cover substantially the same area of the wash zone 236 in each of the first wetted region 244 and the second wetted region 246. To facilitate wetting and formation of these covered areas, the spray device 228 is designed to generate the spray trajectory 252 for each of the spray streams 240. In one embodiment, the orientation at which the washing fluid 234 exits the spray device 228, in combination with the flow rate of the washing fluid 234, can determine one or more of the distance 256 and the angular offset 258 for the location 254 of each of the spray streams 240 in the spray pattern 238. For vertical-axis washing machines, the spray device 228 is configured so that the wetted regions extend longitudinally across the entire area of the wash basket 216. This configuration disperses the washing fluid 234 so that wetting occurs in the portions of the wash zone 236 as desired. In one embodiment, the areas covered or wetted by the washing fluid 234 can comprise at least about 65% of the wash zone 236, although other configurations of the spray device 228 and/or the appliance 200 are contemplated in which the covered areas comprise from about 25% to about 50% of the wash zone 236.

Figure 4:
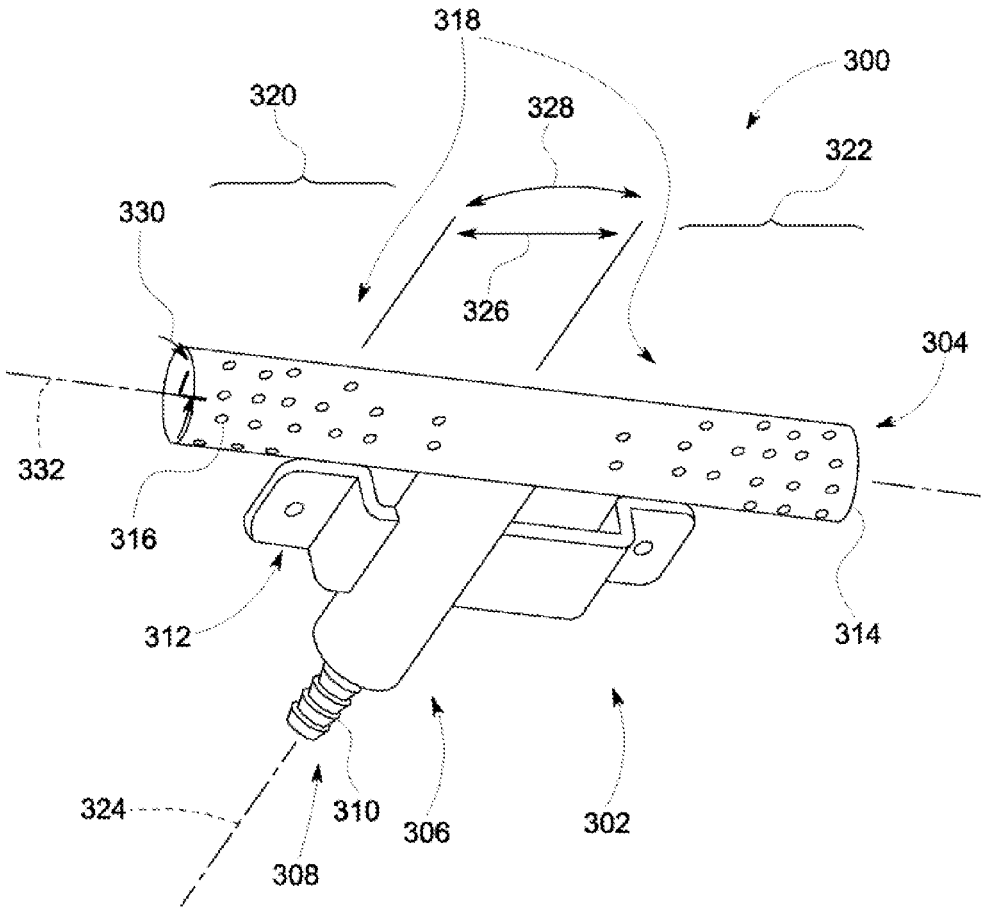
FIG. 4 is a bottom, perspective view of an example of a spray device for use on an appliance such as the appliances of FIGS. 1-3.
Figure 5:
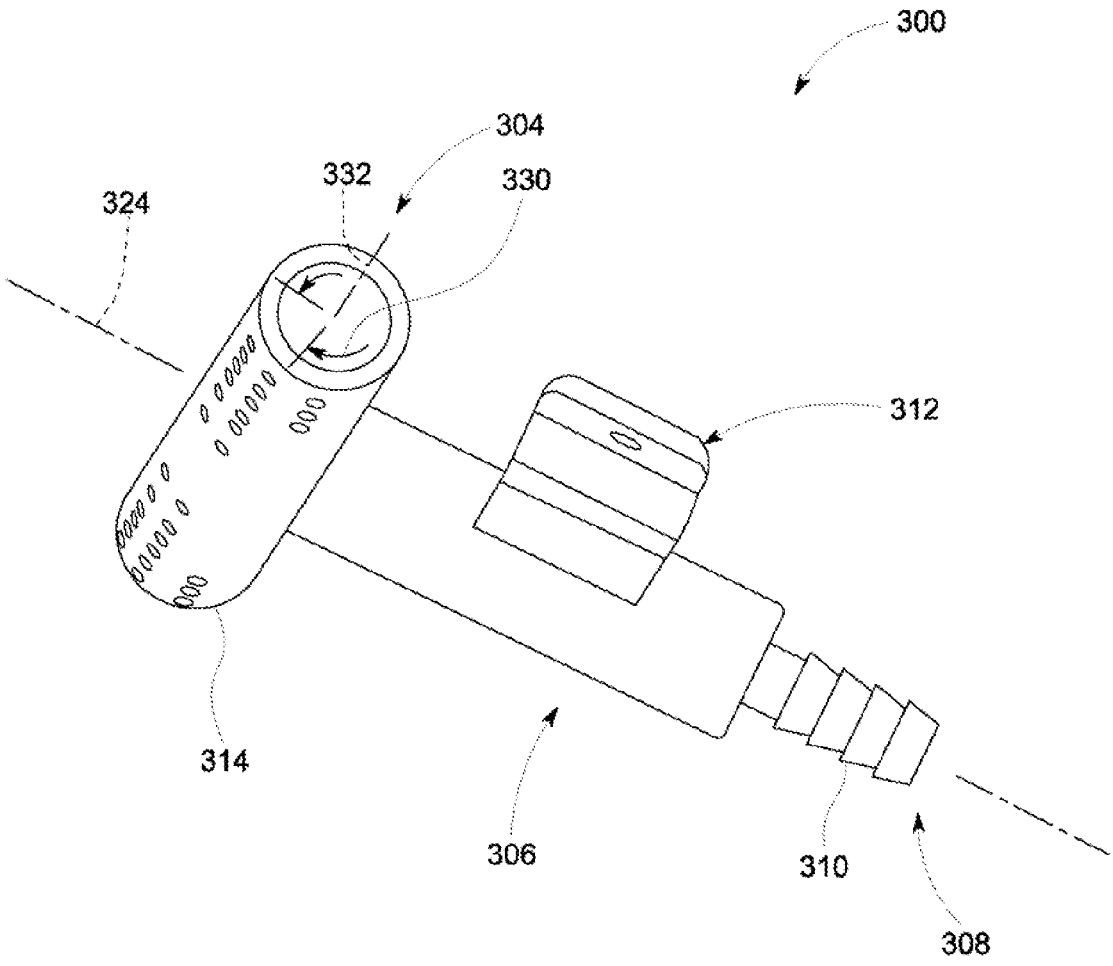
FIG. 5 is a side, perspective view of the spray device of FIG. 4
Figure 6:
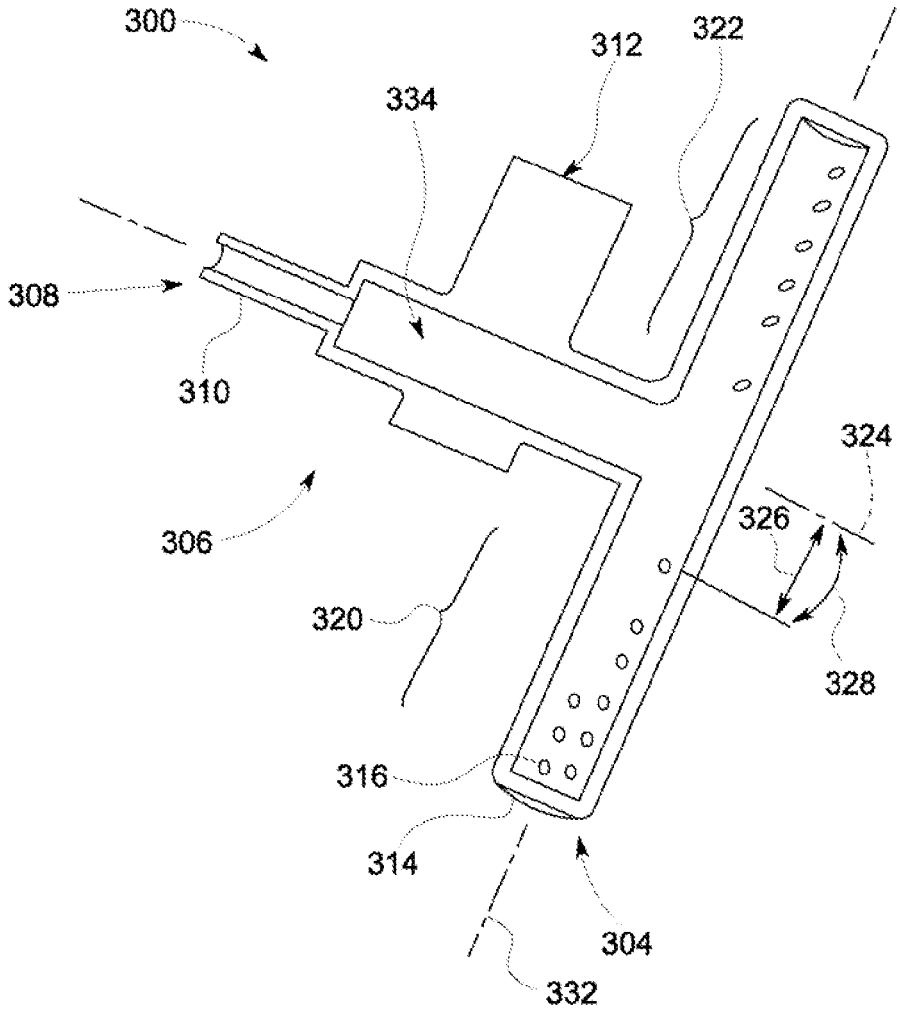
FIG. 6 is a top, perspective, cross-sectional view of the spray device of FIG. 4.

To further understand the design considerations and construction of spray devices (e.g., the spray device 128, 228) embodying the concepts discussed herein, reference can now be had to the example of the spray device 300 illustrated in FIGS. 4-6. Here the spray device 300 comprises a body 302 with a dispersal or first member 304 and an inlet or second member 306 attached thereto. The inlet member 306 includes an inlet 308, which is configured to receive a fluid (e.g., the washing fluid 234 (FIG. 3)) such as by way of a fitting 310 secured to the end of the inlet member 306. A bracket or mounting device 312 is provided on the body 302 for securing the spray device 300, e.g., inside of the appliances 100 and 200 as discussed above.

The dispersal member 304 comprises a head portion 314 with a plurality of apertures 316 through which the washing fluid flows out of the spray device 300. The apertures 316 are arranged in one or more arrays, generally identified by the numeral 318, with at least one of the apertures 316 on either side of a first axis 324. In one example, the array 318 can include a first array 320 and a second array 322 that are arranged on opposite sides of the first axis 324. The apertures 316 are defined on the head portion 314 by one or more dimensions, and in this particular construction the location, position, and/or orientation of each of the apertures 316 is defined by an offset distance 326 and a pitch angle 328, each measured from the central axis 324, and a yaw angle 330 measured with respect to a second axis 332 that extends through the head portion 314 and perpendicular to the central axis 324. As best depicted in FIG. 6, in which the spray device 300 is shown in cross-section, the body 302 has an interior cavity 334 or generally hollow interior. The interior cavity 334 permits the washing fluid to flow through the body 302 such as from the fitting 310 to the apertures 316.

Construction of the spray device 300 can employ a variety of materials and manufacturing processes, each being selected to provide the general configuration and arrangement of the features disclosed herein. The spray device 300 is amenable, for example, to materials such as metals, plastics, and composites, and more particularly to those materials that are typically related to consumer goods and devices. Therefore selection is often dictated by factors such as cost, size, shape, and reliability. The body 302 can be a single unitary structure, wherein the various members (e.g., the inlet member 306 and the head portion 314) and components (e.g., the fitting 310) are formed monolithically with one another. Materials and manufacturing techniques can also be used so that in other constructions, the spray device 300 is formed as separate pieces that are assembled together with fasteners such as adhesives to secure together the various pieces and components.

Although the body 302 is illustrated in FIGS. 4-6 as comprising tubular or cylindrical components (e.g., the inlet member 306 and the head portion 314), the body 302 may have a form factor that is embodied in any shape and size that is receivable inside of appliances such as the appliance 100 and 200. The form factor may be, for example, rectangular and/or square. Likewise the form factor may incorporate other fluid components such as tubes and conduits, which can be arranged so as to conduct the washing fluid to the apertures 316. The fitting 310 can be incorporated into the body 302, such as in the form of threads, or be attached or secured as a separate component such as a barbed or quick-release fluid fitting.

A variety of factors may be considered to determine the arrangement (e.g., the offset distance 326, the pitch angle 328, and the yaw angle 330) for each of the apertures 316. As discussed above, the layout of the apertures 316 is generally determined by way of the wetting desired in the wash zone (e.g., the wash zone 236). This wetting can dictate the number of apertures 316, which can be selected in connection with the number of spray streams (e.g., the spray streams 240) required to effectuate wetting of the desired portion of the wash zone. In one example, the apertures 316 are configured to generate at least one spray stream with a distance (e.g., the distance 256) equal to about the diameter of the wash basket. In another example, the apertures 316 are configured to cause one or more spray streams that terminate in locations that are spaced apart by about 20 mm. In still another example, each of the first array 320 and the second array 322 can form at least about 20 individual spray streams, and in one construction of the spray device 300 there are 38 individual spray streams.

Other factors can be considered and which, alone or in combination with the factors discussed and contemplated herein, influence the arrangement of the apertures. These factors include the flow rate of the washing fluid, which is typically about 3.5 gallons/min, but which can vary as between about 1.5 gallons/min to about 5 gallons/min. Devices for the flow device 232 can be configured to provide for such flow rate while also accommodating for variations in the flow rate from the fluid supply (not shown) that can occur as between households in which these appliances (e.g., the appliances 100 and 200) are located.

Another factor is the relative location of the spray device 300 such as in relation to one or more of the wash basket (e.g., the wash basket 116, 216) and the agitator (e.g., the agitator 124, 224). In the examples discussed herein, the spray devices (e.g., the spray devices 128, 228) are fixed in position at the rear, upper most portion of the wash basket. However, this position can vary as with the design and arrangement of the components of the appliance. In one embodiment, the spray device 300 is configured to accommodate for the relative position with the wash basket to effectuate the wetted regions contemplated herein.

Still another factor is the configuration (e.g., dimensions and shape) of the apertures 316, which can vary as between apertures 316 and among and between the arrays 318 to effectuate the concepts disclosed herein. It may be desirable, for example, that the apertures 316 are sized and shaped to prevent or reduce clogging, which can occur by way of minerals, deposits, and other particulates and contaminates that are found in the washing fluid. As depicted in FIGS. 4-6, the apertures 316 have a rounded or circular shape, although other shapes such as square, rectangular, and triangular may be acceptable to generate wetting as desired. When instantiated as circular openings, the apertures 316 have in one example a diameter of about 2 mm, which is uniformly distributed across the apertures 316 of the array 318.

Figure 7:
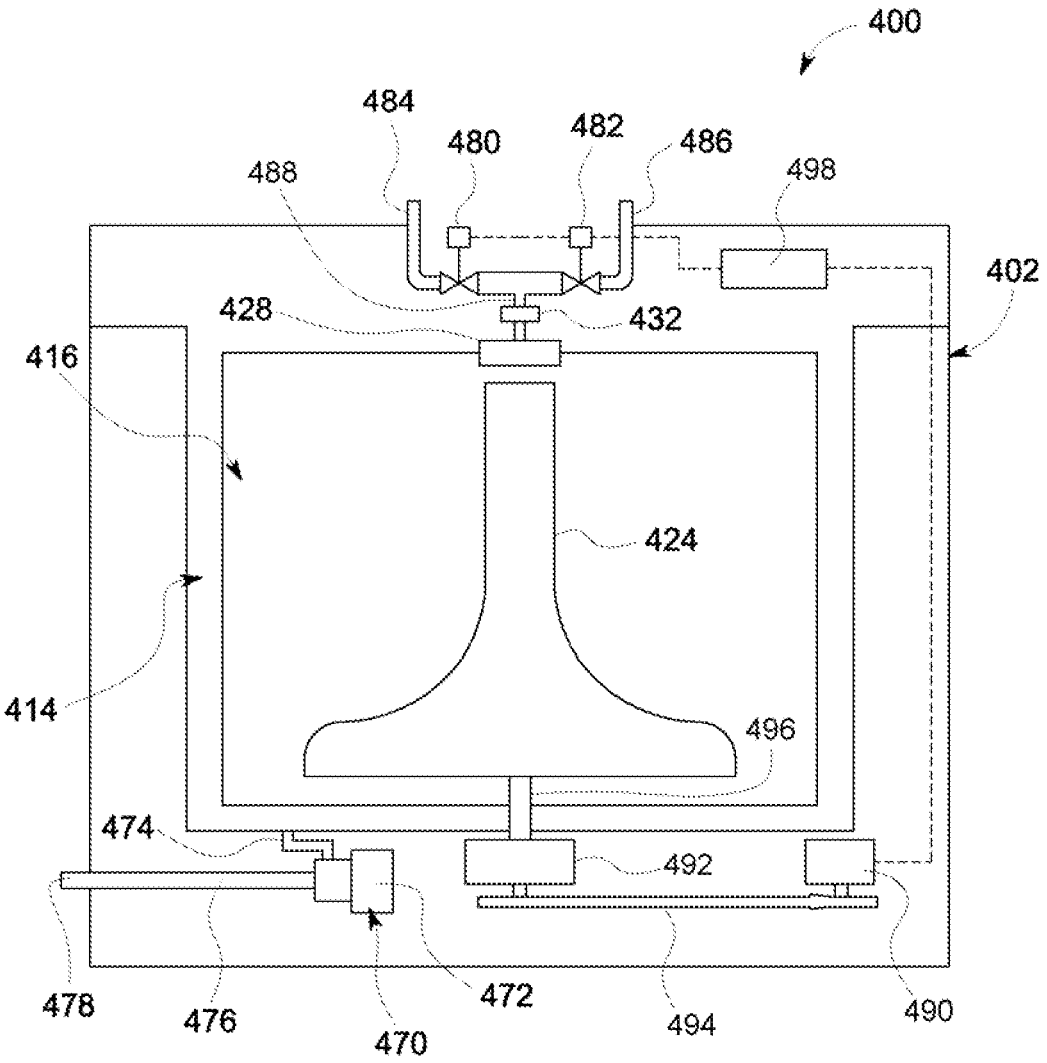
FIG. 7 is a side, cross-sectional view of another exemplary embodiment of an appliance.

A variety of benefits are realized from wetting facilitated by spray devices such as the spray device 300 and related configurations. Some of these benefits are discussed above and below in connection with FIGS. 7-10 in which another exemplary embodiment of an appliance 400 is illustrated. Like numerals are also used to identify like components as between FIGS. 1-3 and FIGS. 7-10. As depicted in FIG. 7, the appliance 400 is a vertical-axis washing machine 402 that comprises a wash tub 414, a wash basket 416 rotatably mounted or supported within the wash tub 414, an agitator 424, a spray device 428, and a flow device 432.

The appliance 400 also comprises a pump assembly 470 that is located beneath the wash tub 414 and the wash basket 416 for gravity assisted flow when draining the wash tub 414. The pump assembly 470 includes a pump/motor 472 and in an exemplary embodiment a motor fan (not shown). A pump inlet hose 474 extends from the wash tub 414 to the pump/motor 472 and a pump outlet hose 476 extends from the pump/motor 472 to a drain outlet 478 and ultimately to a building plumbing system discharge line (not shown) in flow communication with the drain outlet 478. In operation, pump assembly 470 can be selectively activated to remove liquid from the wash tub 414 and the wash basket 416 through drain outlet 478 during appropriate points in washing cycles as appliance 400 is used.

A hot liquid valve 480 and a cold liquid valve 482 deliver fluid, such as water, to the spray device 428 through a respective hot liquid hose 484 and a cold liquid hose 486. Liquid valves 480, 482 and liquid hoses 484, 486 together form a liquid supply connection for the appliance 400 and, when connected to a building plumbing system (not shown), provide a water supply for use in the appliance 400. Liquid valves 480, 482 and liquid hoses 484, 486 are connected to a basket inlet tube 488, which is coupled to the flow device 432, and fluid is dispersed from the basket inlet tube 488 through the spray device 428 in a given spray pattern as described herein.

In an exemplary embodiment, the wash basket 416 and the agitator 424 are driven by a motor 490 through a transmission clutch system 492. A transmission belt 494 is coupled to the motor 490 and the transmission clutch system 492 such as through respective pulleys and shafts. Transmission clutch system 492 facilitates driving engagement of the wash basket 416 and the agitator 424 through a shaft 496 for rotatable movement within the wash tub 414, and transmission clutch system 492 facilitates relative rotation of the wash basket 416 and the agitator 424 for selected portions of wash cycles. Motor 490, transmission and transmission clutch system 492, and transmission belt 494 can collectively be referred to as a machine drive system, the machine drive system being drivingly connected to the wash basket 416 and the agitator 424 for rotating the wash basket 416 and/or the agitator 424.

Operation of the appliance 400 can be controlled by a controller 498. For example, the controller 498 can be operatively connected to the user interface input (e.g., the user interface input 112 (FIG. 1)) located on the backsplash (e.g., the backsplash 108 (FIG. 1)) for user manipulation to select washing machine cycles and features. In response to user manipulation of the user interface input, the controller 498 operates the various components of the appliance 400 to execute selective machine cycles and features. The controller 498 can also be operatively coupled to the flow device 432, the inlet valves (e.g., the hot liquid valve 480 and the cold liquid valve 482), and machine drive system (e.g., the motor 490 and the transmission clutch system 492).

Figure 8:
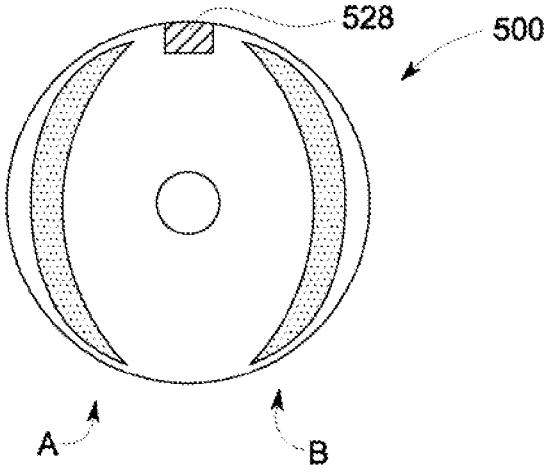
FIG. 8 is a top view of a first orientation of a wash basket, which can be found in an appliance such as the appliances of FIGS. 1-3 and 7.
Figure 9:
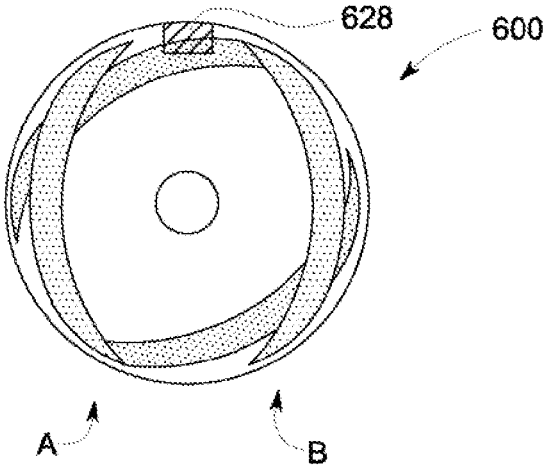
FIG. 9 is a top view of a second orientation of a wash basket, which can be found in an appliance such as the appliances of FIGS. 1-3 and 7.
Figure 10:
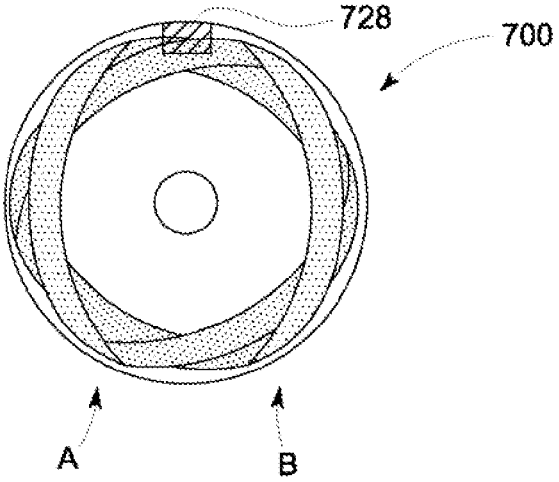
FIG. 10 is a top view of a third orientation of a wash basket, which can be found in an appliance such as the appliances of FIGS. 1-3 and 7.

With continued reference to the appliance 400 of FIG. 7, and as best depicted in FIGS. 8-10, the appliance 400 is configured for a plurality of orientations of the wash basket 416, including a first orientation 500 (FIG. 8), a second orientation 600 (FIG. 9), and a third orientation 700 (FIG. 10). Each of the orientations is indicative of the position of the wash basket (e.g., the wash basket 416) such as would occur during operation of conventional washing machines and in particular vertical-axis washing machines as described and contemplated herein. At each of the positions, the washing fluid is dispersed from the spray device (e.g., the spray device 528, 628, 728), thereby forming in the wash basket a first wetted region and a second wetted region, each generally identified by the letter A and B, respectively.

Changes in the orientation of the wash basket such as between the first orientation 500, the second orientation 600, and the third orientation 700, exposes different parts of the wash basket to the washing fluid. In one embodiment, the position of the wash basket in each of the orientations occurs at random such as would occur for appliances that are not configured to actively initiate and/or stop motion of the wash basket. This random action is indicative of the vertical-axis washing machine 402, wherein the machine drive system is configured without brakes, sensors, or other feedback devices that would indicate to, e.g., the controller 498, the position of the wash basket in the wash tub and/or relative to the spray device. Rather the motion of the wash basket, and more particularly rotational motion of the wash basket, stops by way of, for example, inherent friction in the machine drive system. To further illustrate, and in consideration of the present example, it is contemplated that the second orientation 600 defines a position for the wash basket that is random as related to the position of the wash basket in the first orientation 500. The inventors recognize, however, that the concepts disclosed and contemplated herein are likewise applicable to other types of machine drive systems, such as those systems that provide adequate feedback for locating and positioning the wash basket in, e.g., one or more of the first orientation 500, the second orientation 600, and the third orientation 700.

Figure 11:
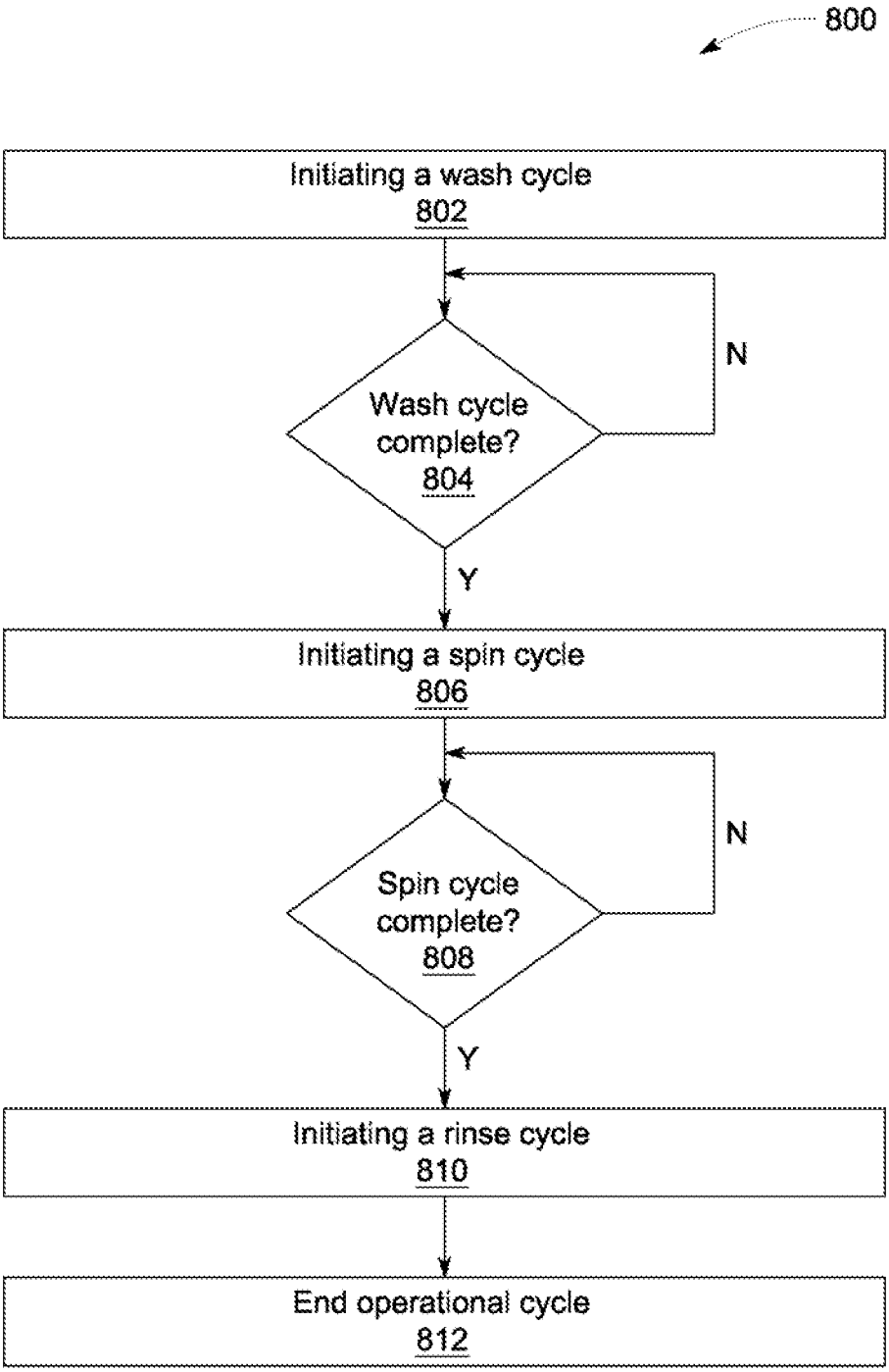
FIG. 11 is a flow diagram of an example of an operational cycle for an appliance such as the appliances of FIGS. 1-3 and 7.

Referring next to FIG. 11, an operational cycle 800 is provided that can be implemented on the appliances (e.g., the appliances 100, 200, and 400) discussed above. At a high level, the operational cycle 800 comprises a series of phases or cycles that can be used, alone or in combination, and also in various configurations to facilitate cleaning of the objects in the appliances. These phases can further comprise various internal steps, such as dispensing steps in which additive (e.g., liquid detergent) is permitted to flow or otherwise is introduced into the wash basket (e.g., the wash basket 116, 216, and 416). Although not necessarily discussed or illustrated herein, such internal steps and those steps related to the operation of appliances such as washing machines, and in particular vertical-axis washing machines, are contemplated within the scope and spirit of the present disclosure.

With continued reference to FIG. 11, it is depicted that the operational cycle 800 includes, at block 802, initiating a wash cycle and, at block 804, determining whether the wash cycle is complete. The operational cycle 800 also comprises, at block 806, initiating a spin cycle and, at block 808, determining whether the wash cycle is complete. The operational cycle 800 further includes, at block 810, initiating a rinse cycle and, at block 812, completing the operational cycle such as by indicating to the end user that the operational cycle 800 is complete.

Focusing on the rinse cycle at block 810, it is contemplated that the wash basket will be placed in one or more of the various orientations discussed in connection with FIGS. 8-10.

Figure 12:
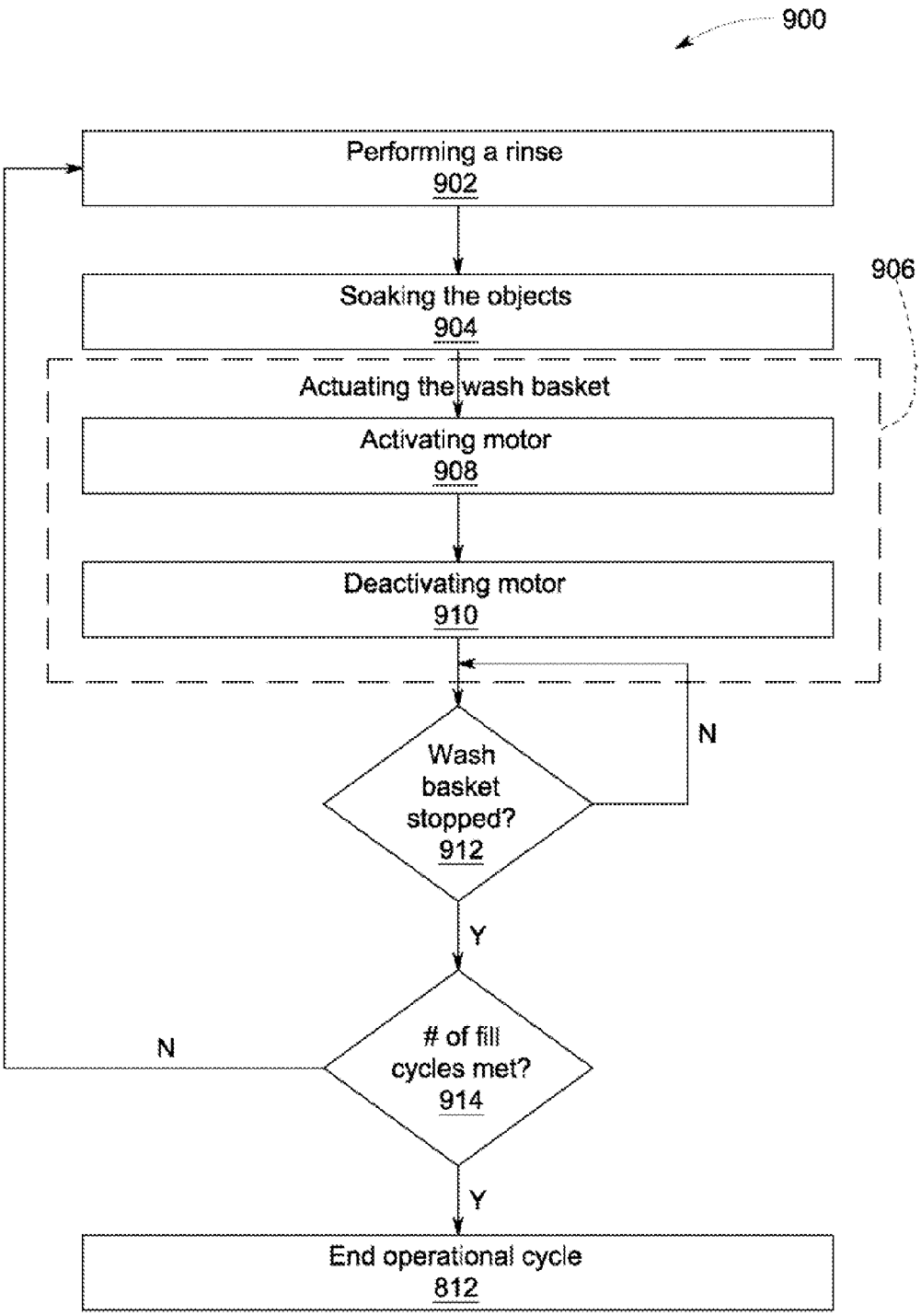
FIG. 12 is a flow diagram of an example of a rinse cycle, which can be implemented as part of an operational cycle such as the operational cycle of FIG. 11.

In one embodiment, and with reference to FIG. 12, a rinse cycle 900 for implementation at block 810 (FIG. 11) comprises, at block 902, performing a rinse at an orientation of the wash basket. In one example, the rinse disperses the washing fluid into the first wetted region (e.g., the first wetted region 244, A) and a second wetted region (e.g., the second wetted region 246, B) on either side of a longitudinal axis of a wash zone formed in the wash basket. The method 900 also comprises at block 904, soaking the objects, and, at block 906, actuating the wash basket. In one embodiment, the block 906 can comprise, at block 908, activating a motor to spin the wash basket and, at block 910, deactivating the motor such as after a pre-determined period of time. The rinse cycle can also comprise, at block 912, determining whether the wash basket has stopped spinning, which can be after the expiration of a pre-set time period, e.g., measured by a timing circuit. If the basket is determined to be stopped, then the rinse cycle includes, at block 914, whether a pre-determined number of fill cycles have been met, at which point the filling can be reactivated and/or the rinse cycle is completed and the operational cycle is concluded such as at block 812.

When implemented on, e.g., the appliances 100, 200, and 400, the rinse (e.g., block 902) can comprise a number of rinses. This number can be defined by a pre-determined and/or pre-set number such as from 2 to 10. For example, if the pre-determined number of rinses is 2, then implementation of the rinse cycle may include performing a first rinse and performing a second rinse, wherein the first rinse and the second rinse are separated by actuation of the wash basket. Likewise, actuation of the wash basket can move the wash basket among and between different orientations, such as from the first orientation 500 (FIG. 500) to the second orientation 600 (FIG. 6) and from the second orientation 600 (FIG. 6) to the third orientation 700 (FIG. 7). This movement can be effectuated so that the position of each of the orientation is random relative to other orientations and positions of the wash basket. Moreover, the amount of water that is dispersed during each rinse (e.g., the first rinse and the second rinse) can be regulated in a number of ways. Flow, fill, and similarly situated and configured sensors can be used, for example, to measure the amount of the washing fluid that is dispersed during the rinse. In one embodiment, the washing fluid is dispersed during each rinse for a pre-determined period of time such as would be used to determine the actuation of one or more valves (e.g., the hot liquid valve 480 and a cold liquid valve 482) to permit the washing fluid to flow to the basket. In one example, the pre-determined time period is independent of characteristics of the objects to be rinsed, wherein these characteristics include, but are not limited to, the type and construction (e.g., fabric) of the objects, as well as the number and the size of the load (e.g., the number, quantity, and/or weight of the objects) to be rinsed. In other embodiments, however, it is also contemplated that the appliances can be configured with settings, which are selected in one example by the end user, and which particularly configure the appliance such as by setting the pre-determined period of time and/or other features of the rinses that are based on characteristics of the objects to be rinsed.

In view of the foregoing, the inventors recognize that the random orientations of the wash tub, in combination with the configuration of the spray device (e.g., the spray devices 128, 228, 300, 428, 528, 628, 728), will permit sufficient wetting of the objects so as to reduce the amount of washing fluid that is required to achieve adequate rinsing of the objects. By way of example, implementation of the concepts described herein will utilize about 1 to 2 gallons of water, which is dispersed for each rinse cycle 900 that is implemented on the appliance. In one embodiment, the number of the rinse cycle 900 that are implemented is from about 2 to about 5, and in one example does not exceed 3, thereby requiring in that case a maximum of about 6 gallons of water to sufficiently rinse the objects washed therein.

Figure 13:
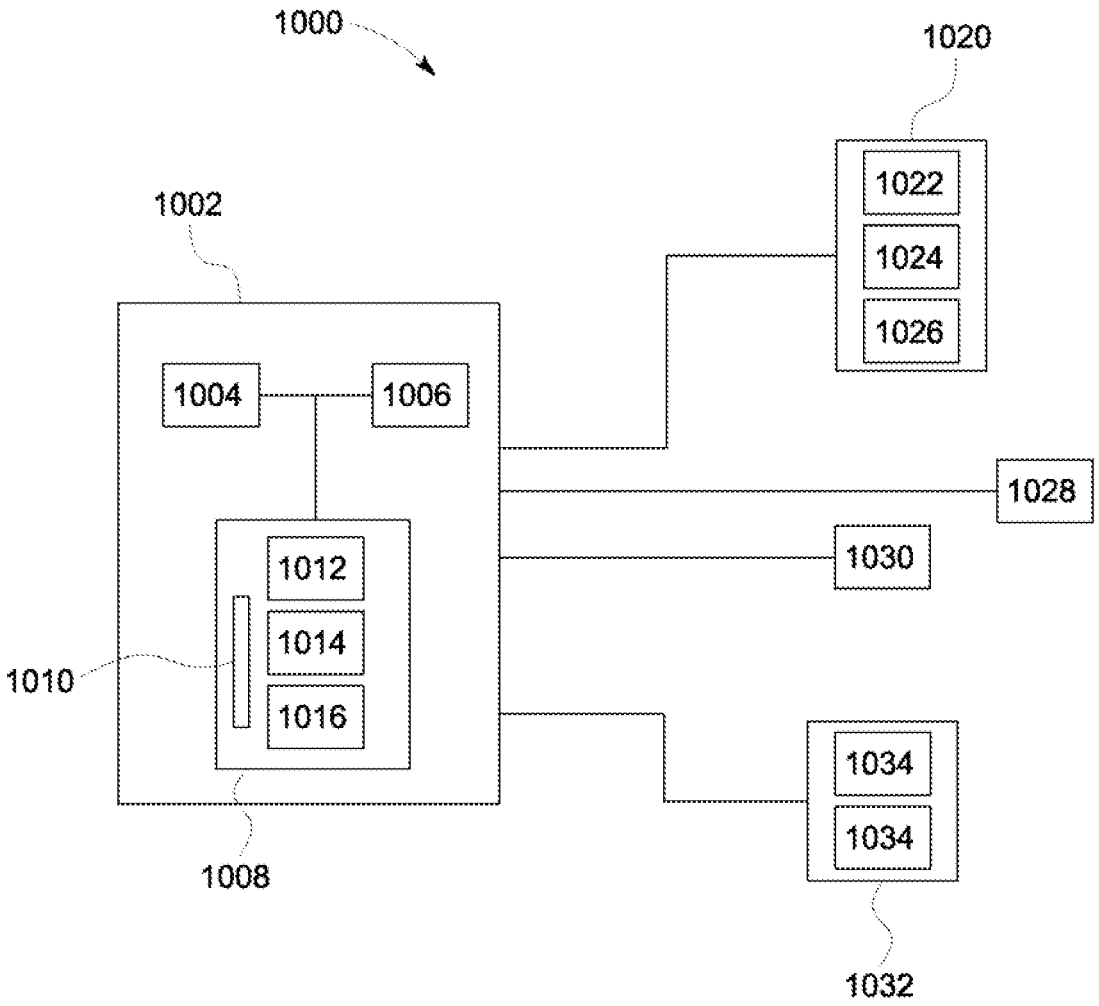
FIG. 13 is a schematic diagram of an example of a control scheme for use with an appliance such as the appliances of FIGS. 1-3 and 7.

A variety of control configurations and schemes can be used to implement the operational cycles, e.g., the operational cycle 800, and the concepts of the present disclosure. The example of FIG. 13 provides a schematic diagram of one configuration of an exemplary control scheme 1000 for use in, e.g., the appliances 100, 200, and 400, and related embodiments ("the appliances"). The control scheme 1000 includes a controller 1002, which includes a processor 1004, a memory 1006, and control circuitry 1008 configured for general operation of the appliances. The control circuitry 1008 comprises a timing circuit 1010, a motor control circuit 1012, a pump control circuit 1014, and a valve control circuit 1016. All of these components are coupled together and communicate to one another when applicable via one or more busses 1018.

The control scheme 1000 further includes valves 1020, illustrated in the present example as a flow device 1022 (e.g., the flow device 132, 232, 432) and valves 1024, 1026 (e.g., the liquid valves 480, 482). The control scheme 1000 also includes a motor 1028 and a pump 1030. In one embodiment, the controller 1002 is coupled to a control panel 1032 that includes one or more wash cycle controls 1034. When implemented in the appliances, the controller 1002 effectuates operation of various elements of the appliances such as in response to inputs from the control panel 1026. The timing circuit 1010, of which various configurations are contemplated, is provided to indicate times and time periods to, e.g., initiate one or more of the wash cycle, the spin cycle, and the rinse cycle. These time periods may be selected, in connection with or wholly separate from the configuration of the appliance so as to facilitate the cleanliness of the objects in the appliance as contemplated herein.

The control scheme 1000 and its constructive components are configured to communicate amongst themselves and/or with other circuits (and/or devices), which execute high-level logic functions, algorithms, as well as firmware and software instructions. Exemplary circuits of this type include, but are not limited to, discrete elements such as resistors, transistors, diodes, switches, and capacitors, as well as microprocessors and other logic devices such as field programmable gate arrays ("FPGAs") and application specific integrated circuits ("ASICs"). While all of the discrete elements, circuits, and devices function individually in a manner that is generally understood by those artisans that have ordinary skill in the electrical arts, it is their combination and integration into functional electrical groups and circuits that generally provide for the concepts that are disclosed and described herein.

The electrical circuits of the controller 1002 are sometimes implemented in a manner that can physically manifest logical operations, which are useful to facilitate the timing of the various cycles of the appliance. These electrical circuits can replicate in physical form an algorithm, a comparative analysis, and/or a decisional logic tree, each of which operates to assign an output and/or a value to the output such as to actuate the valves 1020, to activate the motor 1022, and/or to activate the pump 1024.

In one embodiment, the processor 1004 is a central processing unit (CPU) such as an ASIC and/or an FPGA. The processor 1004 can also include state machine circuitry or other suitable components capable of receiving inputs from, e.g. the control panel 1026. The memory 1006 includes volatile and non-volatile memory and can be used for storage of software (or firmware) instructions and configuration settings. Each of the a timing circuit 1010, the motor control circuit 1012, the pump control circuit 1014, and the valve control circuit 1016 can be embodied as stand-alone devices such as solid-state devices. These devices can be mounted to substrates such as printed-circuit boards, which can accommodate various components including the processor 1004, the memory 1006, and other related circuitry to facilitate operation of the controller 1002 in connection with its implementation in the fluid dispensing appliances.

However, although FIG. 13 shows the processor 1004, the memory 1006, the timing circuit 1010, the motor control circuit 1012, the pump control circuit 1014, and the valve control circuit 1016 as discrete circuitry and combinations of discrete components, this need not be the case. For example, one or more of these components can be contained in a single integrated circuit (IC) or other component. As another example, the processor 1004 can include internal program memory such as RAM and/or ROM. Similarly, any one or more of functions of these components can be distributed across additional components (e.g., multiple processors or other components).

It is further contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An appliance, comprising:

a wash zone in which objects to be cleaned are positioned;

a wash basket having a top, a bottom, and an outer peripheral wall that bounds and defines the wash zone, the wash basket further comprising a rear portion and a front portion spaced apart from the rear portion;

an agitator disposed in and aligned with a center axis of the wash basket, the agitator having a body extending from the bottom of the wash basket and terminating proximate the top of the wash basket;

a spray device in a fixed location relative to the wash zone that is above and proximate the rear portion of the wash basket, the spray device comprising, a body comprising an inlet member and a dispersal member in the form of, respectively, a first hollow tubular structure and a second hollow tubular structure in angular relation to the first hollow tubular structure, the first hollow tubular structure forming an inlet with a central axis that aligns with the center axis of the wash basket, and a plurality of apertures arranged in an array on the second hollow tubular structure of the dispersal member, the array of apertures comprising an aperture on either side of the central axis and in flow communication with the inlet, wherein the array is configured to eject a washing fluid in a spray pattern with spray streams that originate from the plurality of apertures proximate the fixed location and traverse the wash zone to form a first wetted region and a second wetted region on either side of the agitator, and wherein the plurality of apertures comprises at least one aperture disposed on a forward-facing surface of the second hollow tubular structure that configures the at least one aperture to eject the washing fluid in a first spray stream that reaches the front portion of the wash basket.

2. An appliance according to claim 1, wherein the spray device is configured to form the first wetted region and the second wetted region on opposing sides of the wash zone.

3. An appliance according to claim 1, wherein the first wetted region and the second wetted region are proximate the outer peripheral wall of the wash basket.

4. An appliance according to claim 1, wherein the outer peripheral wall defines a circular body with a diameter, and wherein at least one of the first wetted region and the second wetted region extends from a first location proximate the spray device to a second location spaced apart from the first location a distance of at least 50% of the diameter of the circular body.

5. An appliance according to claim 1, wherein the spray device is configured to form a non-wetted region that separates the first wetted region and the second wetted region, and wherein the non-wetted region includes a portion of the wash zone that is directly in front of and behind the agitator.

6. An appliance according to claim 1, further comprising a flow device that is in flow communication between a fluid supply and the spray device, wherein the flow device is configured to maintain a constant inlet fluid pressure of the washing fluid.

7. An appliance according to claim 1, wherein the array of apertures comprises a plurality of apertures arranged in a first array and a second array, and wherein the second array has the same number of apertures as the first array.

8. An appliance according to claim 1, wherein the dispersal member has a longitudinal axis that is perpendicular to the central axis and positions a portion of the second hollow tubular structure on either side of the central axis, and wherein at least one aperture of the array is defined by an angle with respect to each of the central axis and the longitudinal axis.

9. An appliance according to claim 8, wherein the angle of the at least one aperture of the array is configured to maintain the spray pattern given a substantially constant inlet pressure of the washing fluid.

10. An appliance according to claim 1, wherein the spray streams form the first wetted region and the second wetted region from a first location proximate the body to a second location spaced apart from the first location a distance of at least 50% of a longitudinal dimension of the wash zone.

11. An appliance according to claim 1, wherein the first wetted region and the second wetted region are configured to together cover at least about 65% of the wash zone.

* * * * *